US006402577B1

(12) United States Patent
Treinen et al.

(10) Patent No.: US 6,402,577 B1
(45) Date of Patent: Jun. 11, 2002

(54) INTEGRATED HYDRAULIC STEERING SYSTEM FOR A MARINE PROPULSION UNIT

(75) Inventors: Kerry J. Treinen, Malone; Darin C. Uppgard, Neshkoro, both of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/815,741

(22) Filed: Mar. 23, 2001

(51) Int. Cl.[7] ..... B63H 5/12
(52) U.S. Cl. ..... 440/61
(58) Field of Search ..... 440/58, 60, 61

(56) References Cited

U.S. PATENT DOCUMENTS

| | | | | |
|---|---|---|---|---|
| 3,879,301 A | | 4/1975 | Cairns | 252/12 |
| 3,896,036 A | | 7/1975 | Cairns | 252/12 |
| 3,994,814 A | | 11/1976 | Cairns | 252/12.6 |
| 4,228,757 A | | 10/1980 | Woods | 114/150 |
| 4,419,084 A | | 12/1983 | Borst | 440/58 |
| 4,449,470 A | | 5/1984 | Rump | 114/150 |
| 4,592,732 A | | 6/1986 | Ferguson | 440/61 |
| 4,773,882 A | | 9/1988 | Rump | 440/61 |
| 5,127,856 A | | 7/1992 | Kabuto | 440/60 |
| 5,213,527 A | * | 5/1993 | Fetchko | 440/61 |
| 5,240,445 A | | 8/1993 | Aoki et al. | 440/58 |
| 5,244,426 A | | 9/1993 | Miyashita et al. | 440/60 |
| 5,330,375 A | * | 7/1994 | Tsujii et al. | 440/61 |
| 5,601,463 A | * | 2/1997 | Kobelt | 440/61 |
| 5,626,502 A | | 5/1997 | Novey | 440/60 |
| 5,658,177 A | * | 8/1997 | Wagner | 440/61 |
| 5,997,370 A | | 12/1999 | Fetchko | 440/61 |
| 6,146,220 A | | 11/2000 | Alby et al. | 440/53 |
| 6,183,321 B1 | | 2/2001 | Alby et al. | 440/61 |

* cited by examiner

*Primary Examiner*—S. Joseph Morano
*Assistant Examiner*—Lars A. Olson
(74) *Attorney, Agent, or Firm*—William D. Lanyi

(57) ABSTRACT

A hydraulic steering system is provided in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

20 Claims, 9 Drawing Sheets

INTEGRATED HYDRAULIC STEERING SYSTEM FOR A MARINE PROPULSION UNIT

BACKGROUND OF THE INVENTION

1. Field of the Invention

The present invention is generally related to a steering device for a marine propulsion system and, more particularly, to an integrated steering system that is disposed within a support structure of the marine propulsion unit to minimize the movement of components of the steering actuator relative to support structure when the marine propulsion system is rotated either about its steering axis or its tilting axis.

2. Description of the Prior Art

As is well known to those skilled in the art of marine propulsion systems, As hydraulically actuated steering systems or power steering systems typically incorporate hydraulic cylinders that are mounted on the marine propulsion system in a way that requires portions of the hydraulic actuator to move with the marine propulsion system as it is tilted about its tilting axis or rotated about its steering axis. This arrangement causes interference between associated components of the marine propulsion system.

U.S. Pat. No. 5,997,370, which issued to Fetchko et al on Dec. 7, 1999, describes an outboard hydraulic steering assembly with reduced support bracket rotation. The hydraulic steering assembly applies a force to a tiller arm of a marine, outboard propulsion unit and rotates the propulsion unit about a steering axis between a center position and hard over positions to each side of the center position. The propulsion unit is supported for arcuate movement about a tilt axis which is generally perpendicular to the steering axis. The steering assembly includes a hydraulic steering cylinder with an elongated piston rod reciprocatingly mounted within the cylinder for movement along a piston rod axis. A pair of support arms are pivotable about the tilt axis and are connected to the piston rod, allowing arcuate movement of the rod about the tilt axis, while maintaining the rod axis parallel to the tilt axis. A member is pivotally mounted on the tiller arm for pivoting about a first axis which is parallel to the steering axis. The cylinder arm is connected to the cylinder and extends radially outwards from the piston rod axis. The cylinder arm is pivotally connected to the member for pivoting about the second link axis which is parallel to the piston rod axis. The cylinder arm moves through a partially rotated position when the propulsion unit rotates from the center position to either hard over position. The second link axis and the rod axes are on a plane parallel to the steering axis at the partially rotated position.

U.S. Pat. No. 4,419,084, which issued to Borst on Dec. 6, 1983, describes a power assisted steering mechanism for a marine propulsion device. An outboard motor for a boat includes a support adapted to be fixed relative to the boat hull, and a propulsion assembly including a rotatably mounted propeller. It is connected to the support for pivotal steering movement about a steering axis. The outboard motor also includes a pair of elongated members, coupled together for linear extension and retraction upon rotation of one of the elongated members with respect to the other of the elongated members, with the end of one of the members being connected to the propulsion assembly for causing pivotal movement of the propulsion assembly about the steering axis. It further comprises an assembly for fixing the other of the elongated members against longitudinal movement and a push pull cable assembly for selectively causing rotation of one of the elongated members with respect to the other of the elongated members.

U.S. Pat. No. 4,449,470, which issued to Rump on May 22, 1984, describes an hydraulic control package for a marine steering system. The package is intended for use in a marine steering system which has a steering helm pump with port and starboard fluid outlets and a return inlet for hydraulically actuating a piston in a hydraulic cylinder having port and starboard inlets for moving the piston back and forth in the cylinder in response to fluid delivered from the helm pump. A fluid reservoir is closed and pressurized with air and is defined by an open ended tube having a cap sealing the top end of the tube and a valve body sealing the bottom end of the tube. The valve body houses the control valve means for controlling the fluid flow in the system between the helm pump and the actuating cylinder. The cap and valve body are held against the respective ends of the tube by tie rods. The assembly may also include a plurality of steering pumps connected in parallel and through shuttle-tee check valves to the control valve means with a restrictive bypass extending about each shuttle-tee check valve for preventing the nonactive pump from motoring in response to steering fluid output of the active pump while allowing a limited amount of the steering fluid output to flow to the nonactive steering pump.

U.S. Pat. No. 4,773,882, which issued to Rump on Sep. 27, 1988, describes a hydraulic steering assembly for outboard engines. The assembly is secured to a tiller arm of a variety of outboard propulsion units for a boat so as to rotate a propulsion unit about a steering axis. The assembly comprises a hydraulic cylinder having a hydraulically actuated rod member extending therefrom and being rotatably secured to the tiller arm of an outboard propulsion unit about an axis of rotation parallel to the steering axis. The hydraulic cylinder also includes a pivotal connection for attachment to the boat to define a pivot axis generally parallel to the steering axis and nonrotatable about the steering axis. The force exerted by actuation of the hydraulic cylinder against the pivotal connection rotates the outboard propulsion unit about the steering axis.

U.S. Pat. No. 4,228,757, which issued to Wood on Oct. 21, 1980, describes a boat steering assembly. The assembly has a tiller lever for providing a steering input upon being pivoted about a first pivot axis and an actuating lever supported for pivotal movement about a second pivot axis. The ends of the levers are interconnected in order to pivot the tiller lever upon pivoting movement of the actuating lever and for positioning the levers in parallel relationship with one another in a neutral position. The length of the tiller lever from its first pivot is longer than the length of the actuating lever from its second pivot to their respective ends. There is also an actuator assembly comprising a reciprocating member having a hydraulically operated piston at each end which is slidably disposed for movement between two cylinders which are defined by a housing. A first end of a actuating member is operatively connected to the housing and a second end extends out of the housing and is adapted for connection to a steering means. A drive member supported by the reciprocating member provides a driving connection between the actuating lever and the reciprocating member.

U.S. Pat. No. 4,592,732, which issued to Ferguson on Jun. 3, 1986, describes a marine propulsion device power steering system. A marine propulsion device is adapted for mounting to a boat transom and comprises a propulsion unit, a swivel bracket connecting the propulsion unit to the boat transom for pivotal movement of the propulsion unit relative to the boat transom about its steering axis and an extendable and contractable steering link which is pivotally connected to the boat transom and to the propulsion unit for rotating the propulsion unit about the steering axis. The device further comprises an operator actuated extendable and contractable control link connected to the boat transom and to the propulsion unit and operably connected to the steering link for selectively effecting extension and contraction of the steering link in response to operator actuation of the control link.

U.S. Pat. No. 5,127,856, which issued to Kabuto et al on Jul. 7, 1992, describes a power steering system for an outboard motor. The system is capable of permitting an electric motor to be driven only when the driving of the electric motor is required and automatically controlling the steering force of a steering wheel depending upon the steering reaction force. The system is so constructed that a steering cable is moved depending upon the rotation of the steering wheel and the movement of the steering cable is detected by means of a steering force sensor which supplies a signal to a controller. The controller controls the output of the electric motor depending upon the signal.

U.S. Pat. No. 5,240,445, which issued to Aoki et al on Aug. 31, 1993, describes a power steering system for an outboard motor. The system is w mounted upon the body of a hull and includes a steering bracket secured to the body of the hull, a swivel bracket rotatable about a body of the outboard motor, and a pair of clamping brackets supporting the swivel bracket. It comprises a manual steering unit for manually steering a steering element so as to operate the outboard motor. The manual steering unit includes a link mechanism connected to the steering element and connected to the steering bracket. It also comprises a power unit operatively connected to the link mechanism of the manual steering unit.

U.S. Pat. No. 5,244,426, which issued to Miyashita et al on Sep. 14, 1993, describes a power steering system for an outboard motor. The system is disposed outside of rear portion of a hull and usually includes a manual steering system mounted upon the hull for operating a steering element so as to manual steer the outboard motor body. A power unit is operatively connected to the manual steering system and includes an electric motor for applying a steering assist force to the manual steering system.

U.S. Pat. No. 5,626,502, which issued to Novey on May 6, 1997, describes a power steering adapter for outboard powerheads of various size. The adapter is intended to accommodate variations in size and design of outboard motor powerheads, to couple a power steering servo unit to the powerhead, and to utilize existent mounting brackets and steering brackets without restriction on powerhead use. It is characterized by an anchor socket pivoted on a transverse mounting bracket axis to secure a motor operated tiller member at a fixed steering position that shifts its steering center eccentrically with respect to the turning center of the powerhead. The anchor socket accommodates angular displacement caused by the eccentricity.

Various types of bearing materials are available in commercial quantity and are suitable for use within the steering components of a marine propulsion system.

U.S. Pat. No. 3,994,814, which issued to Cairns on Nov. 30, 1976, describes a low friction bearing material and method. The low friction bearing composition comprises a major portion of a thermal plastic resin other than polytetrafluoroethylene and a minor portion of a filled polytetrafluoroethylene material, with the filled polytetrafluoroethylene material consisting essentially of at least 50% by volume of polytetrafluoroethylene polymer and the remainder being a filler material, with the filler material comprising a first filler material and a second, different filler material, the first filler material being selected from the group of soft metals and soft metallic oxides or sulfides having lubricating properties such as lead and its oxides, cadmium and its oxides, titanium oxide, zinc oxide, molybdenum disulfide, and antimony and its oxides and trioxides.

U.S. Pat. No. 3,896,036, which issued to Cairns on Jul. 22, 1975, describes various bearing compositions. The bearing material can comprise, in percent by volume, 40% to 95% of a fluorocarbon resin, such as polytetrafluoroethylene, 5% to 60% of cadmium or an oxide of cadmium, and from 0.1% to about 35% of a filler characterized by a hardness greater than the hardness of cadmium oxide.

U.S. Pat. No. 3,879,301, which issued to Cairns on Apr. 22, 1975, describes a low friction bearing material and method. The bearing composition comprises a major portion of a thermoplastic resin other than polytetrafluoroethylene and a minor portion of a filled polytetrafluoroethylene material, with the filled polytetrafluoroethylene material consisting essentially of at least 50 percent by volume of polytetrafluoroethylene polymer and the remainder being a filler material selected from the group consisting of carbon, glass, asbestos, silica, zinc, cadmium, lead and the oxides thereof, bronze, molybdenum disulfide, tungsten disulfide, alumina, zirconia, titanium oxide, cupric oxide, boron nitride, kieselguhr and mixtures thereof.

U.S. Pat. No. 6,146,220, which issued to Alby et al on Nov. 14, 2000, discloses a pedestal mount for an outboard motor. The outboard motor is mounted to a transom of a boat with a pedestal that is attached either directly to the transom or to an intermediate plate that is, in turn, attached to the transom. A motor support platform is attached to the outboard motor, and a steering mechanism is attached to both pedestal and the motor support platform. The tilting mechanism is attached to the motor support platform and to the outboard motor. The outboard motor is rotatable about a tilting axis relative to both pedestal and the motor support platform. The tilting mechanism is rotatable relative to the pedestal and about a steering axis. The steering axis is generally vertical and stationary relative to the pedestal and is unaffected by the tilting of the outboard motor. The tilting mechanism is rotatable relative to the pedestal and about the steering axis with the outboard motor.

U.S. Pat. No. 6,183,321 B1, which issued to Alby et al on Feb. 6, 2001, discloses an outboard motor with a hydraulic pump and an electric motor located within a steering mechanism. The outboard motor comprises a pedestal that is attached to the transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

The patents described above are hereby expressly incorporated by reference in the description of the present invention.

Known types of steering devices, such as hydraulic steering and power steering systems, all require that a hydraulic cylinder and piston assembly be mounted in some way to the marine propulsion system, to its bracket, or to the transom of a boat in such a way that tilting the marine propulsion system or rotating the marine propulsion system about its steering axis causes movement of the cylinder relative to the marine vessel or, alternatively, causes relative movement about different axes of rotation between the marine propulsion system and the steering mechanism. It would therefore be significantly beneficial if a hydraulic steering system or power steering system could be provided in which the steering mechanism was an integral portion of the marine propulsion system.

SUMMARY OF THE INVENTION

A marine propulsion system made in accordance with the preferred embodiment of the present invention comprises a support structure that is attachable to both a marine propulsion system and to a marine vessel. The marine propulsion system is rotatable about a generally vertical steering axis and also about a generally horizontal tilting axis. A steering arm is attachable to the marine propulsion system and is rotatable about the steering axis. A steering actuator has a first portion attached to the support structure and a second portion attached in force transmitting relation with the steering arm. The first portion remains stationary with respect to the support structure during rotation of the marine propulsion system about either the steering axis or the tilting axis.

In a preferred embodiment of the present invention, the second portion of the steering actuator is moveable along a generally straight line relative to the first portion of the steering actuator. A sliding joint is attached to the second portion of the steering actuator and comprises a linear component and a rotational component. The linear component is attached to the second portion of the steering actuator and the rotational component is disposed within the linear component and rotatable relative to the linear component. The rotational component is shaped to receive the steering arm in sliding relation therein.

The marine propulsion system of the present invention can be either an outboard motor or a stem drive system. The steering actuator, in a preferred embodiment of the present invention, is a hydraulic actuator with the first portion of the steering actuator comprising a hydraulic cylinder and the second portion of the steering actuator comprising a moveable piston within the cylinder in response to changes in hydraulic pressure within the cylinder.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
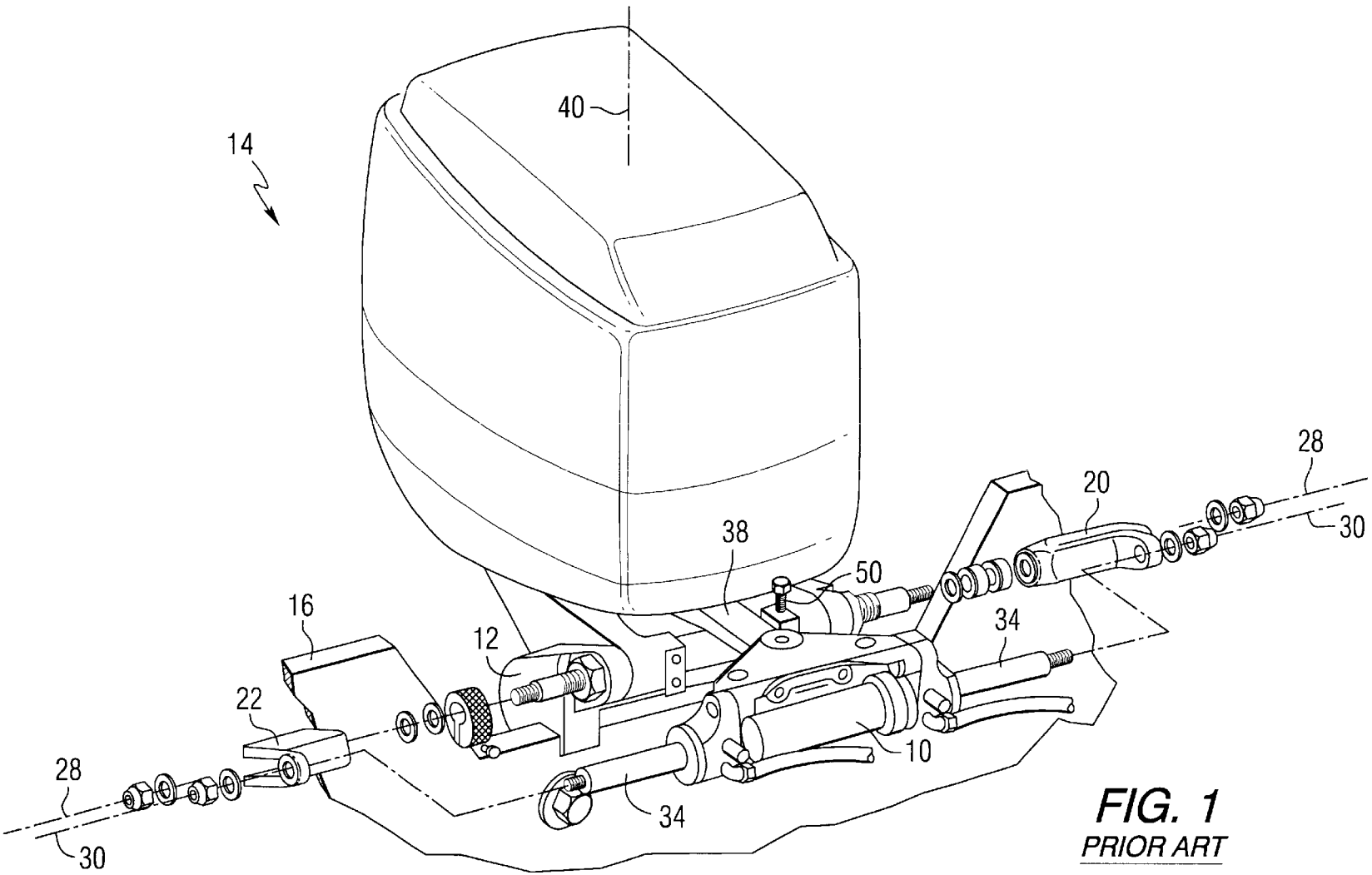
FIG. 1 PRIOR ART
FIG. 1 shows a prior art steering mechanism.

FIG. 1 shows a hydraulic steering system known to those skilled in the art and available in commercial quantities from Teleflex Corporation. A hydraulic cylinder 10 is attachable to a bracket 12 of an outboard motor 14. The bracket 12 serves the purpose of attaching the outboard motor 14 to a transom 16 of a marine vessel. Two adapter brackets, 20 and 22, are used to enable the attachment of the cylinder 10 to the bracket 12.

Axis 28 is the tilt axis of the outboard motor 14 about which the outboard motor rotates relative to the bracket 12 when the outboard motor 14 is tilted or trimmed relative to the transom 16. Axis 30 represents the axis of the piston rod 34 and the central axis of the axially moveable cylinder 10. In the system shown in FIG. 1, the piston rod 34 remains generally stationary and in a fixed relationship with brackets 20 and 22 while the cylinder portion 10 is attached to a steering arm 38 and moves back and forth along a path defined by the piston rods 34. The attachment of the cylinder portion 10 to the steering arm 38 allows the outboard motor 14 to be rotated about its steering axis, which is identified by reference numeral 40 in FIG. 1.

With continued reference to FIG. 1, it can be seen that the tilting axis 28 of the outboard motor 14 is not coaxial with the central axis 30 of the hydraulic cylinder 10 or its piston rods 34. Therefore, when the outboard motor 14 is tilted about its tilting axis 28, the cylinder 10 and its piston rods 34 move relative to the bracket 12 as the cylinder and piston rods rotate about the tilting axis 28 at a distance defined by the distance between the tilting axis 28 and axis 30.

Many different types of hydraulic steering actuators and power steering systems are available in commercial quantities for addition to marine propulsion systems. These "after market" systems all exhibit certain disadvantages. For example, because the cylinder 10 is offset from the tilting axis 28, it protrudes in a forward direction and away from the transom 16. This can result in interference between the steering cylinder 10 and either the boat or the jack plate of the marine propulsion system when either the steering system is operated or the trim and tilt system is operated. The cylinder 10 moves or rotates about the tilting axis 28 at a distance that is equivalent to its offset from the tilting axis 28.

With continued reference to FIG. 1, it can also be seen that a single bolt 50 connects the steering arm 38 with the cylinder 10. In most known systems, this bolt 50 is a conventional 0.375 inch steering bolt, or drag link. All steering loads are transmitted through this steering bolt and the steering bolt has been identified as a weak link in some steering systems known to those skilled in the art. Another disadvantage of the prior art systems is that the piston rods 34, the drag links or bolts 50, and the brackets, 20 and 22, are all exposed to the elements. In addition, hydraulic steering systems that are added to marine propulsion systems, as "after market" components, often result in a cluttered appearance and requires space within the marine vessel.

Figure 2:
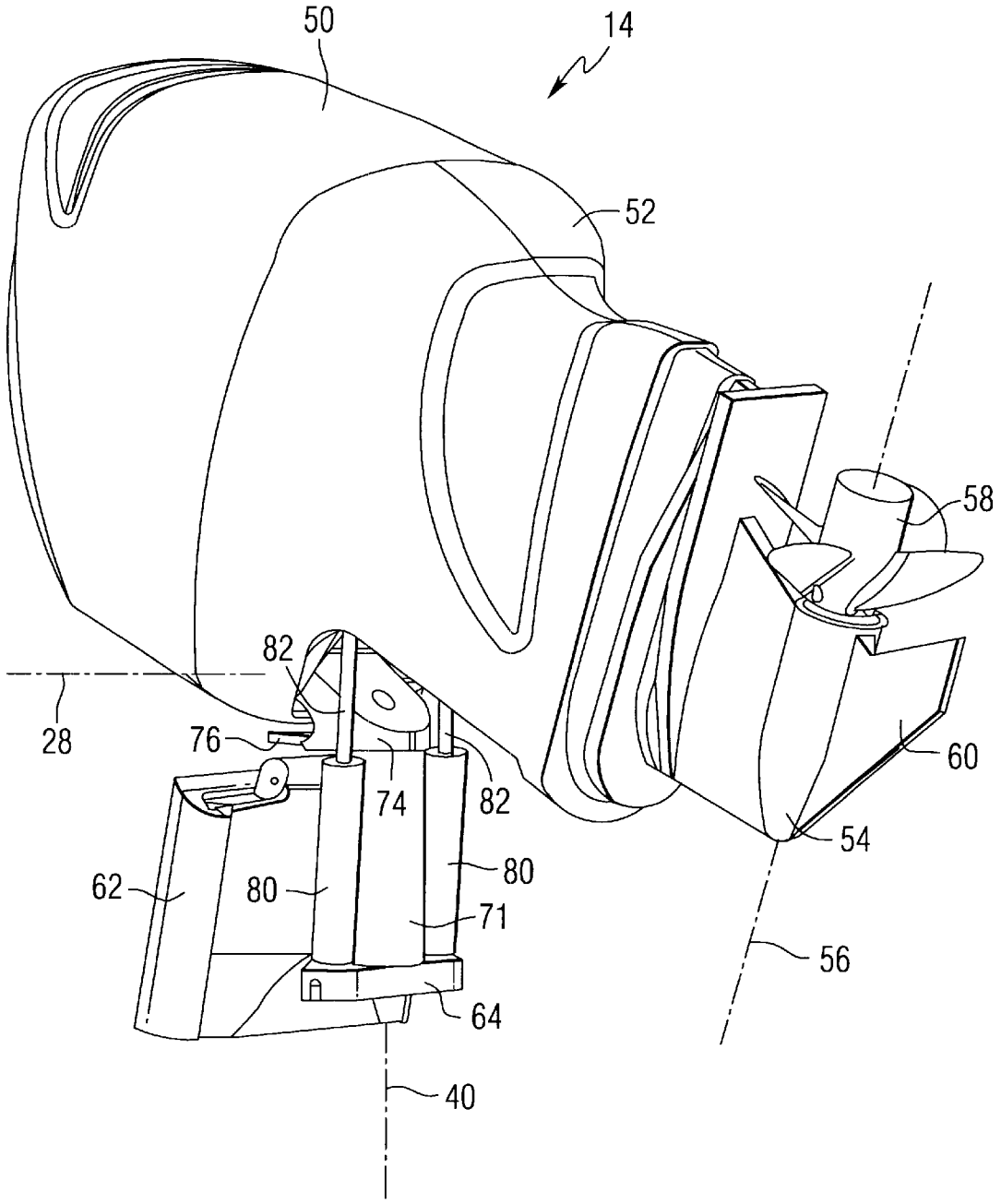
FIG. 2 PRIOR ART
FIG. 2 shows an outboard motor with which the present invention is particularly suited for use.

FIG. 2 is an illustration of an outboard motor 14 such as the marine propulsion system described and illustrated in U.S. Pat. Nos. 6,146,220 and 6,183,321 described above. The structure of the marine propulsion system shown in FIG. 2 and described in detail in the two cited U.S. Pat. Nos. will be referenced below in conjunction with the description of the present invention. The outboard motor 14 illustrated in FIG. 2 has a cowl 50 which is disposed around a powerhead of the marine propulsion system. The midsection 52 houses a driveshaft, an oil sump, an exhaust passage, and other components which support a gearcase 54 in which a propeller shaft (not shown in FIG. 2) is supported for rotation about axis 56 and is attached to a propeller 58. A skeg 60 is attached to the lower portion of the gearcase 54.

A support structure 62 is attachable to a transom of a marine vessel and, in certain embodiments, can comprise a moveable portion that can be moved relative to a jack plate for adjusting the height of the marine propulsion system. A pedestal 64 is attached to the support structure 62 and supports a central housing 71 that, in certain embodiments, can contain an electric motor and an hydraulic pump for providing hydraulic pressure to various hydraulically actuated components of the trim and tilt systems of the marine propulsion system. A steering head 74 is rotatable about the steering axis 40 when an actuating arm 76 is moved. The outboard motor 14 is tilted about its tilting axis 28 by two hydraulic cylinders 80 which each have a piston rod 82. The piston rods 82 are extendable from the cylinders 80 to provide the necessary force to cause the outboard motor 14 to rotate about its tilting axis 28.

Figure 3A:
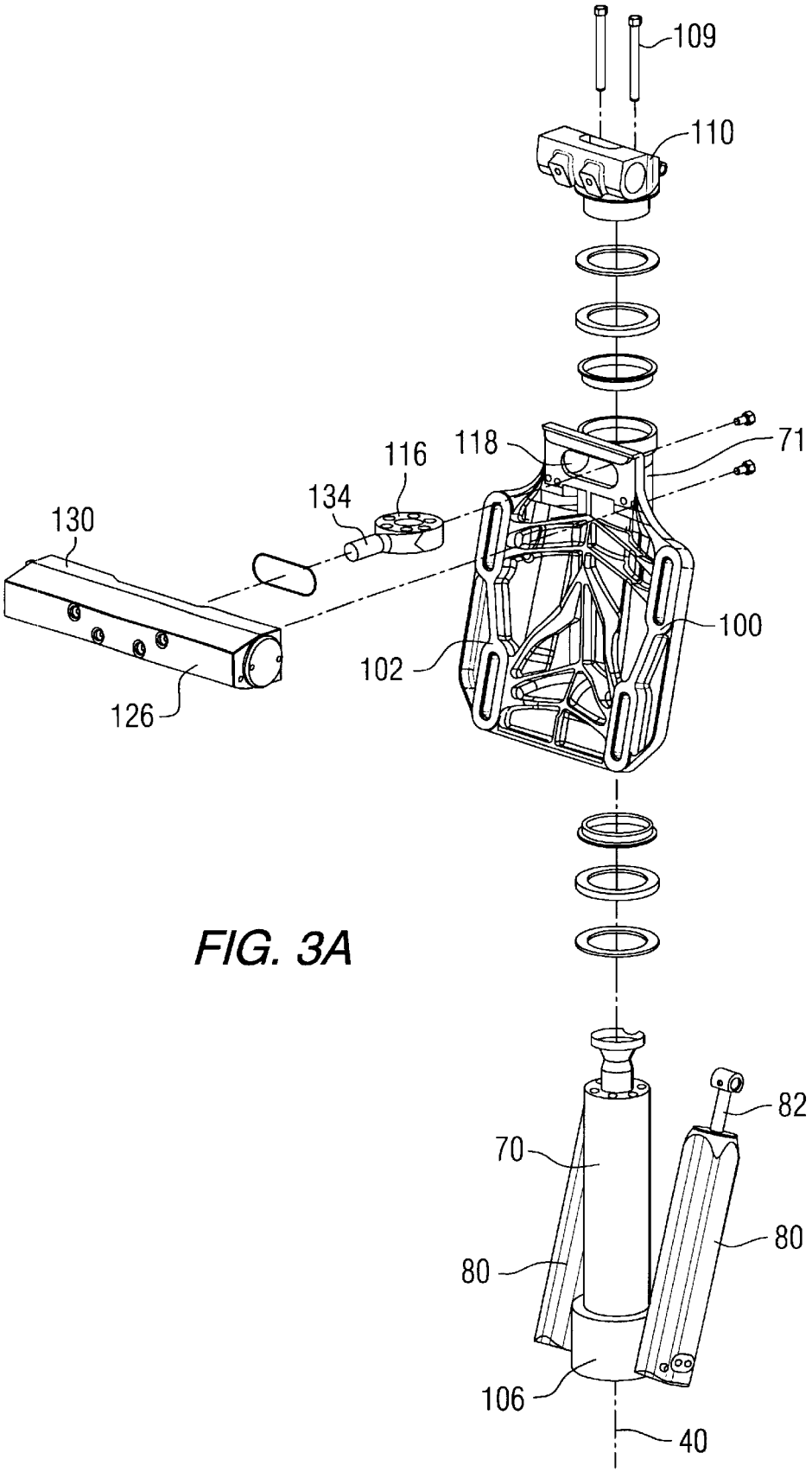
FIGS. 3A and 3B show alternative perspectives of an exploded isometric view of the present invention.
Figure 3B:
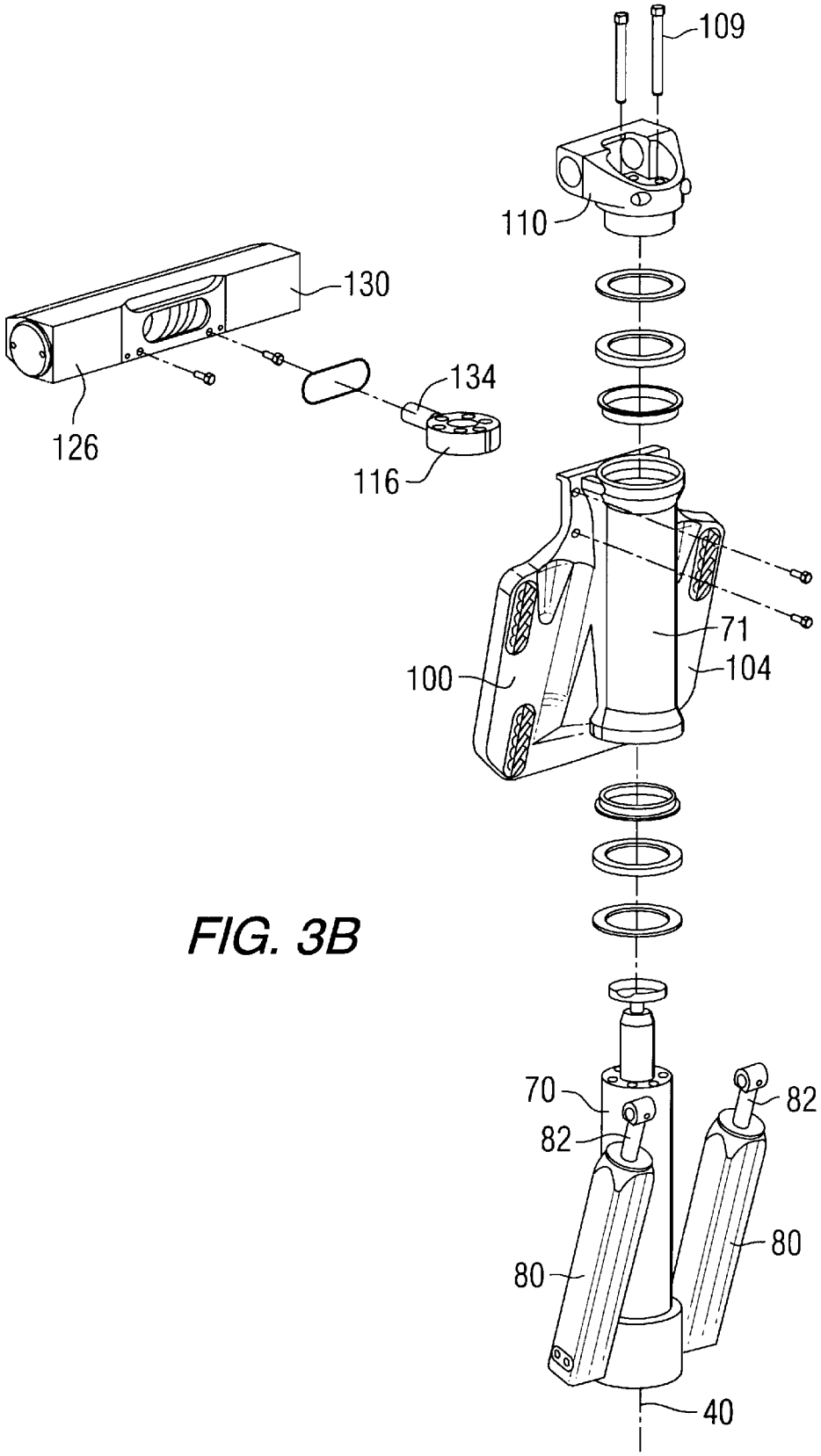

FIGS. 3A and 3B show exploded isometric views of the present invention from two perspectives. FIG. 3A is a view of the present invention from the perspective of the marine vessel to which the support structure 100 is attached. The surface 102 shown in FIG. 3A is shaped to be disposed against an aft surface of the transom of a marine vessel. In FIG. 3B, surface 104 is the rearwardly facing surface of the support structure 100.

With reference to FIGS. 3A and 3B, the support structure 100 is attachable to a marine propulsion system, such as an outboard motor or a stem drive system, and is also attachable to a marine vessel, such as to the transom of the marine vessel. The tubular structure 70, or steering tube, is generally concentric with the steering axis 40 and is attached to a base portion 106 that can be attached to a pedestal 64 such as that described above in conjunction with FIG. 2. A steering head 110 is similar to steering head 74 in FIG. 2 and is shaped to be attached to an outboard motor and is rotatable about the steering axis 40.

With continued reference to FIGS. 3A and 3B, a steering arm 116 is disposed within a cavity 118 of the support structure 100 and the generally circular portion of the steering arm 116 is disposed in concentric relation with the steering axis 40. The steering arm 116 is attachable to the steering head 110 and both of these components are rotatable about the steering axis 40.

A steering actuator comprises a first portion 130 and a second portion (not visible in FIGS. 3A and 3B) which is attached in force transmitting relation with the steering arm 116 and, more specifically, with an extension 134. The first portion 130 of the steering actuator 126 remains stationary with respect to the support structure 100 during rotation of the marine propulsion system about either the steering axis 40 or the tilting axis 28 described above in conjunction with FIGS. 1 and 2.

With continued reference to FIGS. 3A and 3B, it should be understood that the piston rods 82 of the cylinders 80 are intended to be attached to the outboard motor 14, described above in conjunction with FIGS. 1 and 2, and are used to exert an upward force that causes the outboard motor 14 to tilt about its tilting axis 28.

Figure 4:
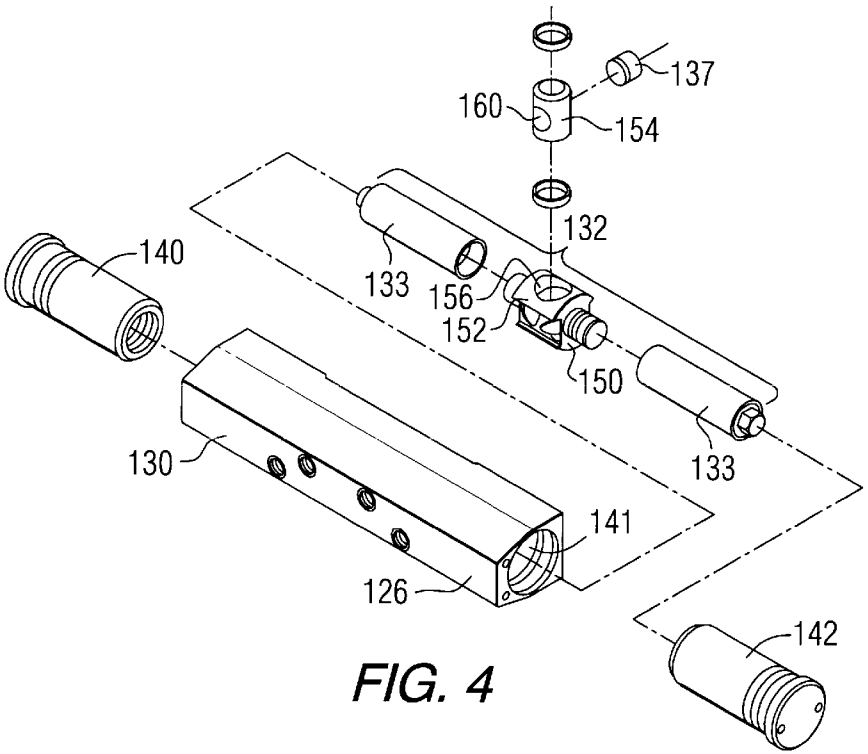
FIG. 4 is an exploded isometric view of a steering actuator made in accordance with the present invention.

FIG. 4 shows the steering actuator 126 with its first portion 130 and its second portion 132. The second portion 132 of the steering actuator 126 is disposed within the first portion 130 and is axially moveable within the internal cylindrical cavity 141 of the first portion 130. The components identified by reference numerals 140 and 142 serve the function of sealing the moveable second portion 132 within the cylindrical cavity of the first portion 130.

With continued reference to FIG. 4, the present invention provides a is sliding joint 150 that is attached to end portions 133 of the second portion 132 of the steering actuator 126. The sliding joint comprises a linear component 152 and a rotational component 154. The linear component 152 is attached to end portions 133 of the second portion 132, as a central element of the second portion 132, and the rotational component 154 is disposed within an opening 156 of the linear component 152. The rotational component 154 is rotatable relative to the linear component 152. A distal end of the extension 134 of the steering arm 116 is shown in FIG. 4 in relation to the rotational component 154. As represented in the isometric exploded view of FIG. 4, a bushing 137 is pressed into the rotational component 154 and shaped to receive the extension 134 which is received in a cylindrical opening 160 of the rotational component 154. When assembled and disposed within the first portion 130, the second portion 132 of the steering actuator 126 is slidable axially within the cylindrical cavity 141 formed within the first portion 130. As the second portion 132 moves axially within the first portion 130, the sliding joint 150 moves with it. The rotational component 154 is disposed within opening 156 and, therefore, also moves along the axial path of the second portion 132. When the distal end of the extension 134 is disposed within opening 160, the distal end of the steering arm 116 is also caused to move in synchrony with the sliding joint 150. As will be described in greater detail below, this movement of the distal end of the extension 134 of the steering 116 causes the steering arm 116 to rotate about the steering axis 40, as described above in conjunction with FIGS. 3A and 3B.

Figure 5:
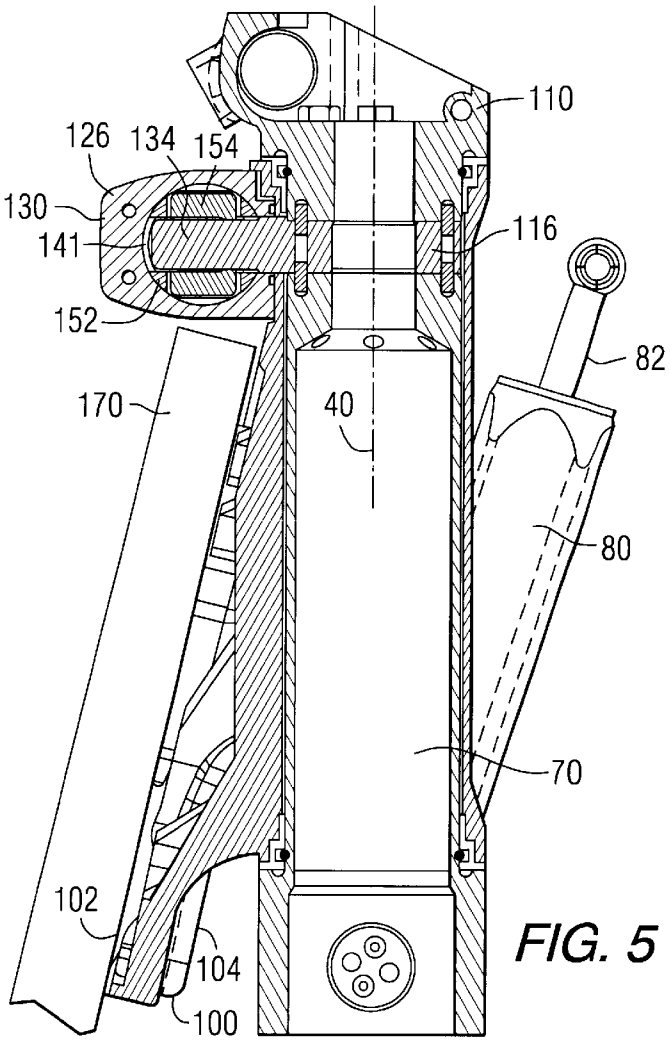
FIG. 5 is a partially sectioned view of the present invention.

FIG. 5 is a partially sectioned view of the present invention, showing a support structure 100, its rearwardly directed face 104, and its forwardly directed face 102 which is disposed in contact with a transom 170 of a marine vessel. The tubular housing 71, the hydraulic cylinder 80, and its piston rod 82 will not be described in detail in conjunction with FIG. 5 in view of the fact that they are illustrated and described in conjunction with FIGS. 3A and 3B, above, and their function is also described in significant detail in U.S. Pat. Nos. 6,146,220, and 6,183,321. The steering head 110 is attached to the upper end 120 of a shaft extending from the cylindrical component 71 and to the steering arm 116. The steering arm 116 is shown disposed within the body of the support structure 100 and, more particularly, within a cavity 118 as described above in conjunction with FIGS. 3A and 3B. It is captured between the steering head 110 and the tubular structure 70, or steering tube. The steering arm 116 and the attached steering head 110 and tubular structure 70, or steering tube, are all rotatable in synchrony about the steering axis 40. The steering actuator 126 is rigidly attached as a stationary portion of the support structure 100, the extension 134 of the steering arm 116 extends into the rotation component 154 of the sliding joint 150, as described above in conjunction with FIG. 4. More specifically, the rotational component 154 is disposed within the linear component 152 which, in turn, is slidably disposed within the internal cylindrical cavity 141 of the first portion 130 of the steering actuator 126. In FIG. 5, reference numeral 176 identifies a plurality of dowel pins. These dowel pins 176 are used to align the steering head 110, the steering arm 119, and the tubular structure 70, which is a steering tube.

With continued reference to FIG. 5, it should be understood that the steering head 110 is intended to be rigidly attached to an outboard motor 14 as described above in conjunction with FIG. 2. Although the steering head identified by reference numeral 74 in FIG. 2 may not be identical to the steering head 110 described above in conjunction with FIGS. 3A, 3B, and 5, these components are generally similar in the fact that they serve the purpose of attaching an outboard motor to the support structure 100.

Figure 6A:
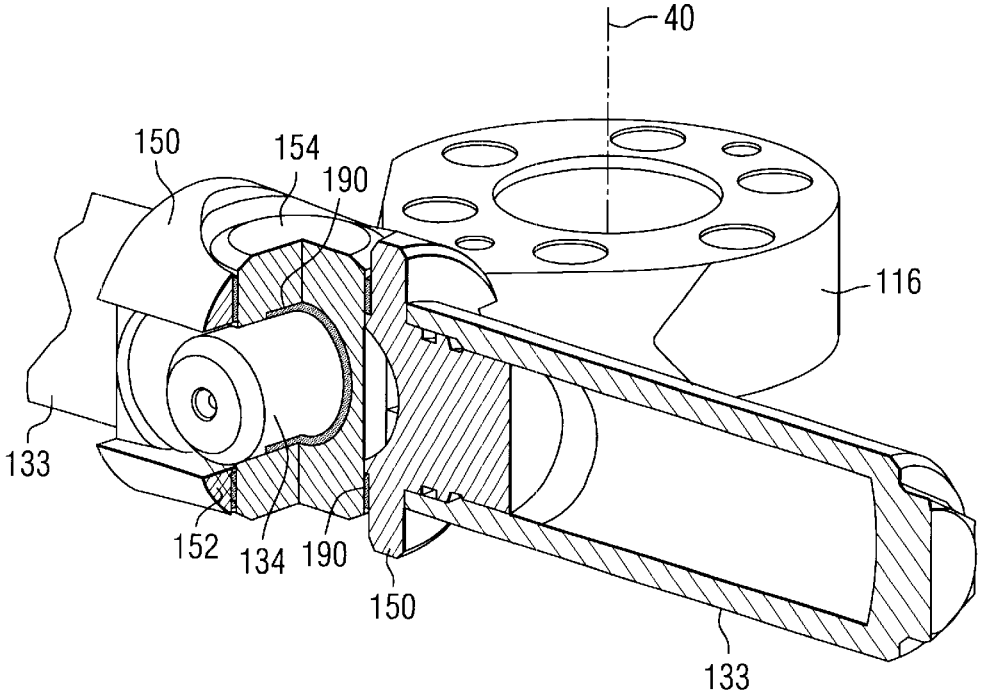
FIGS. 6A and 6B are partially sectioned isometric views of the linearly moveable portion of the steering actuator associated with a steering arm of the present invention.
Figure 6B:
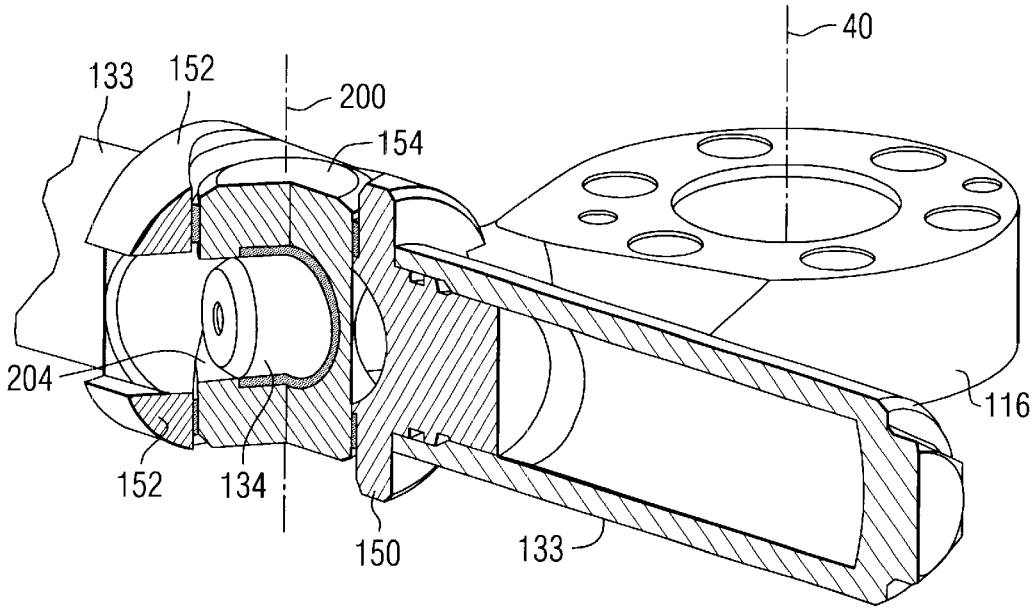

FIGS. 6A and 6B are partially sectioned views of the sliding joint 150 at two different positions relative to the steering axis 40. FIG. 6A represents the present invention when the steering arm 116 is in a central location, as would exist when a marine vessel is being propelled along a straight path and neither turning toward port nor toward starboard. The extension 134 is directed along a centerline of the marine vessel toward its bow and the sliding joint 150 is at a generally central position within the cylindrical cavity 141 of the steering actuator 126, as described above in conjunction with FIG. 4. The extension 134 of the steering arm 116 is illustrated in FIG. 6A as extending through an opening in the rotational component 154 and the rotational component 154 is shown extending through an opening in the linear component 152. The sliding and rotational surfaces are provided with a bearing material 190 which is available in commercial quantities from the Garlock Corporation. This bearing material facilitates the rotation of the rotational component 154 within the cylindrical opening of the linear component 152 and, in addition, facilitates the movement of the extension 134 of the steering arm 116 within the cylindrical opening formed in the rotational component 154 about axis 40.

FIG. 6B is similar to FIG. 6A, but with the steering 116 rotated about the steering axis 40. This rotation of the steering arm 116 about the steering axis 40 is caused by the linear movement of the sliding joint 150 within the cylindrical cavity 141 of the first portion 130 of the steering actuator 126, as discussed above in conjunction with FIG. 4. The linear movement of the sliding joint 150 causes the linear component 152 to move relative to the steering axis 40. This carries the rotational component 154 along the same path. Since the extension 134 extends into the opening of the rotational component 154, the rotational component 154 rotates about axis 200. This combined movement, along both a linear and rotational path, of the rotational component 154 causes the extension 134 to slide within the cylindrical opening 204 formed through the rotational component 154.

With reference to FIGS. 6A and 6B, it can be seen that axial movement of the second portion 132 within the cylindrical cavity 141 of the steering actuator 126 causes the extension 134 of the steering arm 116 to move with the sliding joint 150. This, in turn, causes the steering arm 116 to rotate about the steering axis 40.

Figure 7A:
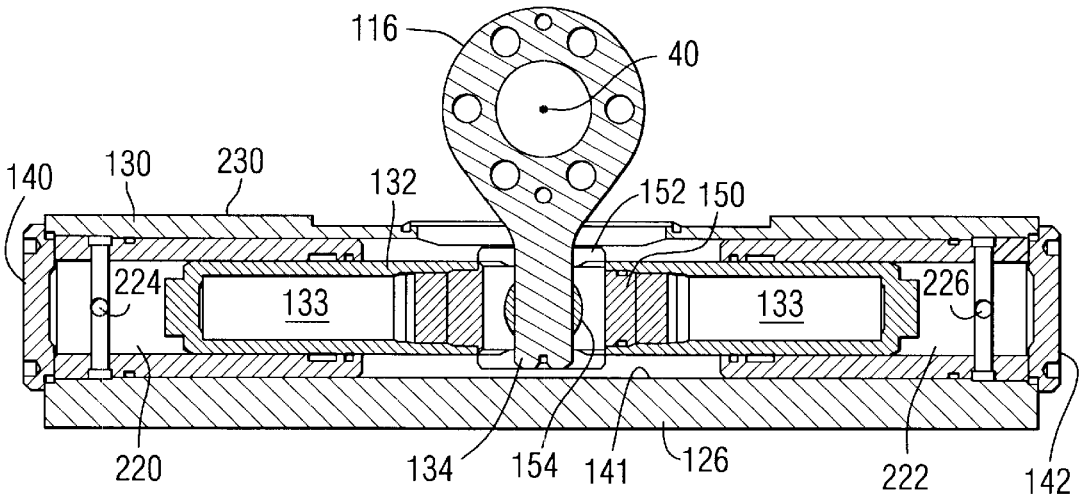
FIGS. 7A and 7B are sectioned top views of the steering actuator of the present invention associated with the steering arm.
Figure 7B:
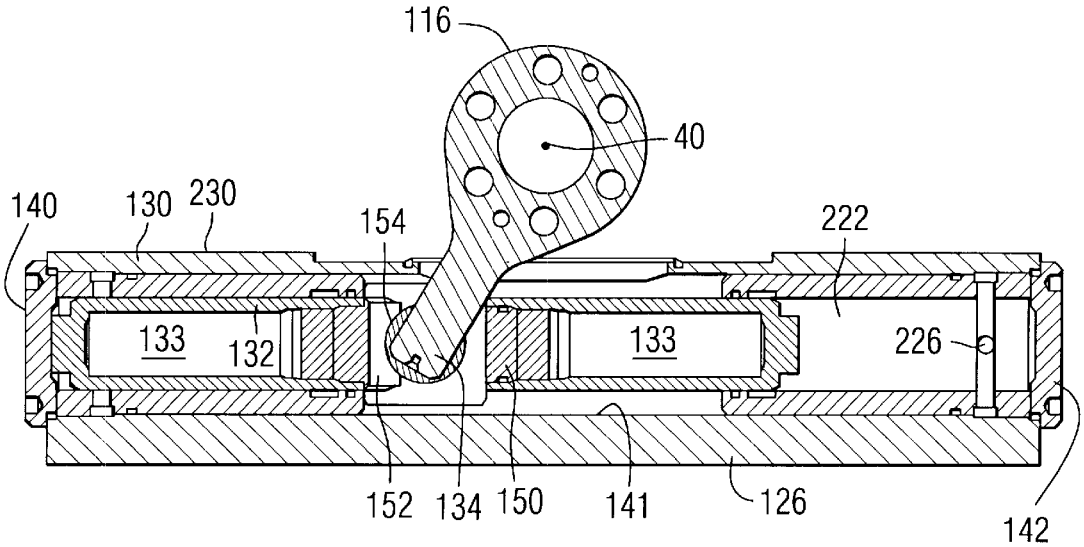

FIGS. 7A and 7B are section views taken through the steering actuator 126 to show the relative movement of the components. FIG. 7A shows the relative positions of the steering arm 116, the sliding joint 150, and the first portion 130 of the steering actuator 126. In FIG. 7A, the extension 134 of the steering arm 116 is directed straight ahead as it would be when the marine vessel is traveling along a straight line and not turning either to starboard or to port. The sliding joint 150 is in a generally central position within the cylindrical cavity 141 of the steering actuator 126. The linear component 152 of the sliding joint 150 is in a central position within the cylindrical cavity 141 and the rotational component 154 is illustrated with the extension 134 extending through the cylindrical opening 160. When in the position shown in FIG. 7A, the hydraulic pressure in cavities 220 and 222 are generally equal. Openings 224 and 226 are provided to allow hydraulic fluid to flow into and out of the two cavities, 220 and 222, at the axial ends of the cylindrical cavity 141 on both sides of the second portion 132 of the steering actuator 126.

FIG. 7B illustrates the relative positions of the components when the second portion 132 of the steering actuator is moved toward one end of the cylindrical cavity 141. When the pressure in cavity 222 is increased, by a flow of hydraulic fluid through opening 226, the second portion 132 is forced toward the other end of the cylindrical cavity 141. This moves the sliding joint 150 to the left in FIG. 7B. Both the linear component 152 and the rotational component 154 are moved with the second portion 132. Since the steering arm 116 is rotationally moveable about the steering axis 40, but not moveable away from the steering axis 40, the extension 134 slides relative to the rotational components 154. This can be seen by comparing the relative positions of the extension 134 and the rotational component 154 in FIGS. 7A and 7B.

With continued reference to FIGS. 7A and 7B, it should be noted that the steering actuator 126 is an integral portion of the support structure when the actuator 126 is rigidly attached to the support structure. Although the support structure is not illustrated in FIGS. 7A and 7B, it should be realized that the rearwardly directed face 230 of the steering actuator 126 is intended to be attached to a corresponding face formed on the forwardly directed surface 102 of the support structure 100, as illustrated in FIG. 5. With the generally circular portion of the steering arm 116 disposed within the cavity 118 of the support structure 100 and with the steering actuator 126 rigidly attached to the support structure 100, the moveable components of the steering mechanism are contained within the support structure. This eliminates the clutter that would otherwise be evident in prior art hydraulic steering systems. In addition, the steering actuator 126 of the present invention is rigidly attached to the support structure 100 and therefore does not move relative to the support structure when the outboard motor is either tilted about its tilting axis 28 or rotated about its steering axis 40. Furthermore, the moving components of the present invention are not exposed to the elements as is common in hydraulic steering systems known in the prior art.

Figure 8B:
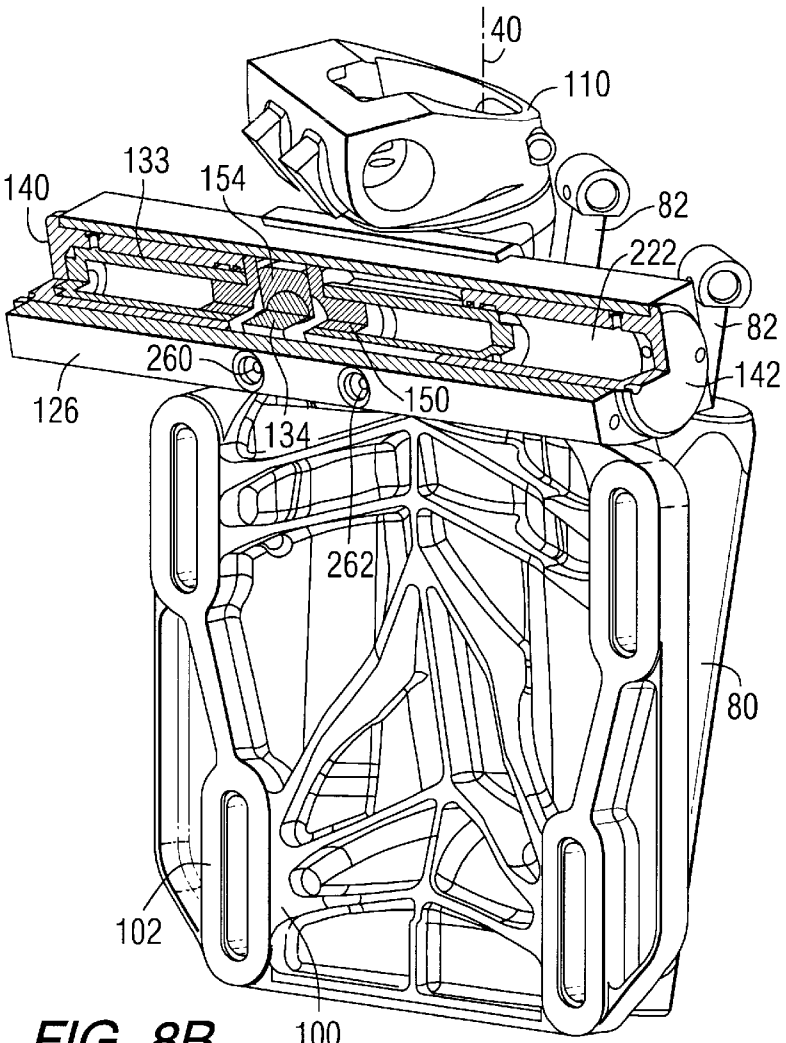
FIGS. 8A and 8B are partially sectioned isometric views of the present invention.
Figure 8A:
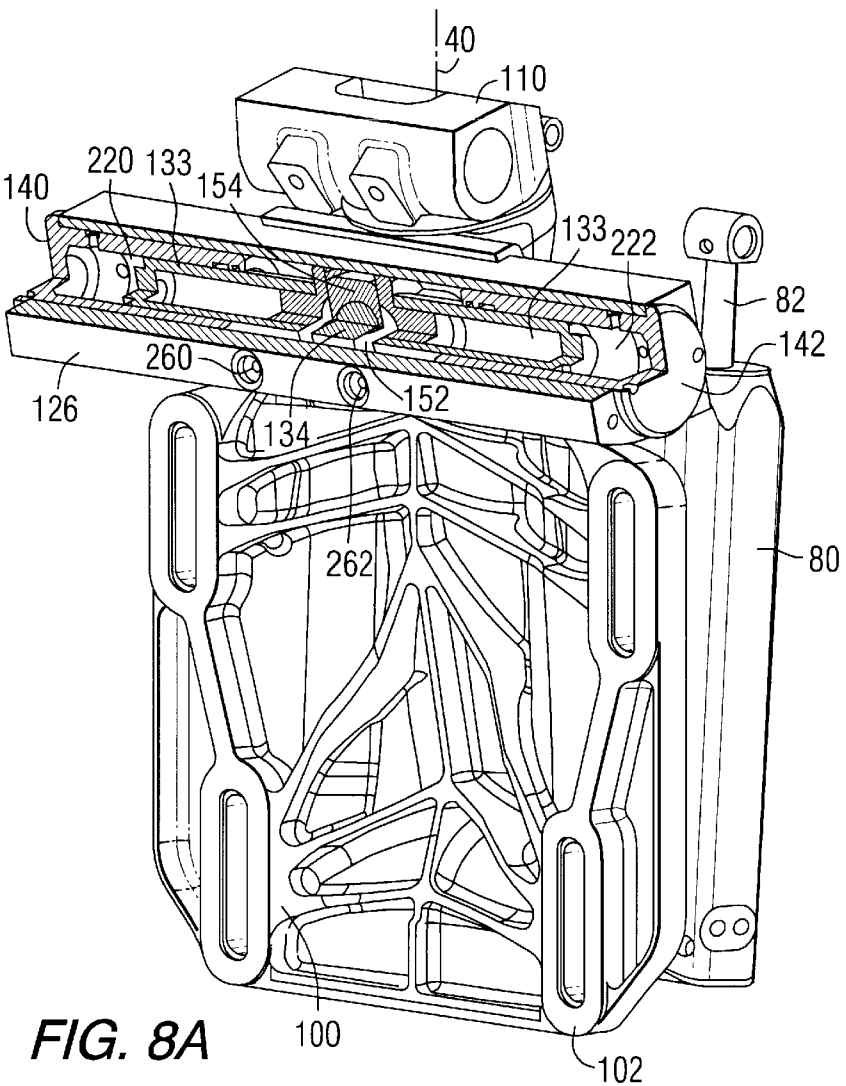

FIGS. 8A and 8B are partially section views of the present invention, shown the relative positions of the steering actuator 126 and the support structure 100, with the second portion 132 disposed within the first portion 130 of the steering actuator 126. It should be noted that FIG. 8A represents a straight ahead position of the steering system similar to that represented in FIGS. 6A and 7A. FIG. 8B represents a rotation of the steering system as would occur during a turn of the marine vessel toward port as is also represented in FIGS. 6B and 7B.

In FIGS. 8A and 8B, two ports, 260 and 262, are shown. These ports are provided to allow hydraulic fluid to be pumped into either cavity 220 or cavity 222 to cause the second portion 132 of the steering actuator 126 to move axially within the cylindrical cavity 141, as described above in conjunction with FIGS. 7A and 7B. It can be seen that neither the steering arm 116 nor its extension 134 is exposed in the preferred embodiment of the present invention. The generally circular portion of the steering arm 116 is located within the cavity 118, as described above in conjunction with FIG. 3A, and the extension 134 is disposed completely within the steering actuator 126. In addition, it can be seen that the steering actuator 126 is an integral part of the support structure 100 when it is attached rigidly to the support structure. Furthermore, the steering actuator 126 does not move relative to the support structure 100 either when the outboard motor is rotated about its steering axis 40 or when the outboard motor is tilted about its tilting axis 28, as described above in conjunction with FIGS. 1 and 2. The present invention provides a compact arrangement for the steering system which reduces the overall space required for the steering mechanism and protects its movable components from exposure. In addition, the present invention allows the hydraulic hoses to remain in a static condition to reduce the chances of abrasion and wear of these components.

Figure 9:
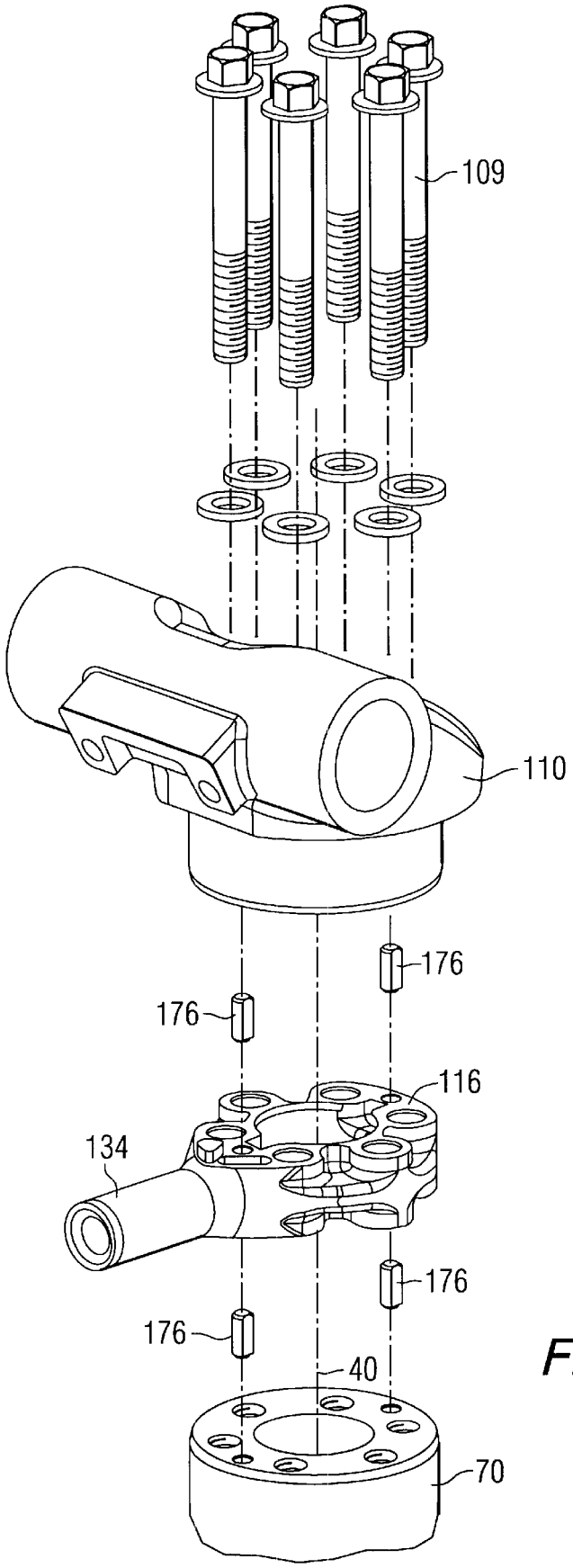
FIG. 9 is an isometric exploded view of the steering head and steering arm of the present invention in combination with certain other illustrated elements of the steering mechanism.

FIG. 9 is an exploded isometric view of certain selected components of the present invention in order to more clearly and specifically describe the relationship between those selected components. The cylindrical component 70, or steering tube, is aligned with the steering arm 116 through the use of the dowels 176. Also, the steering arm 116, is aligned with the steering head 110 by dowels 176. The use of these dowels assures the proper alignment of the steering tube 70, the steering In arm 116 and the steering head 110. FIG. 9 shows six bolts 109 which each extend through an associated washer, the steering head 110, the steering arm 116, and are all threaded into the steering tube 70, or cylindrical component. These is bolts 109 rigidly attach the steering head 110, the steering arm 116, and the steering tube 70 together to rotate as a single unit about axis 40.

Although the present invention has been described in particular detail and illustrated to show a preferred embodiment, alternative embodiments are also within its scope.

We claim:

1. A marine propulsion system, comprising:

a support structure attachable to said marine propulsion system and to a marine vessel, said marine propulsion system being rotatable about a generally vertical steering axis and a generally horizontal tilting axis;

a steering arm attachable to said marine propulsion system, said steering arm being rotatable about said steering axis; and a steering actuator having a first portion attached to said support structure and a second portion attached in force transmitting relation with said steering arm, said steering arm extending into said second portion, said second portion being movable within said first portion, said first portion remaining stationary with respect to said support structure during rotation of said marine propulsion system about either said steering axis or said tilting axis.

2. The system of claim 1, wherein:

said second portion of said steering actuator is movable along a generally straight line relative to said first portion of said steering actuator.

3. The system of claim 1, further comprising:

a sliding joint attached to said second portion of said steering actuator.

4. The system of claim 3, wherein:

said sliding joint comprises a linear component and a rotational component.

5. The system of claim 4, wherein:

said linear component is attached to said second portion of said steering actuator and said rotational component is disposed within said linear component and rotatable relative to said linear component.

6. The system of claim 5, wherein:

said rotational component is shaped to receive said steering arm in sliding relation therein.

7. The system of claim 1, wherein:

said marine propulsion system is an outboard motor.

8. The system of claim 1, wherein:

said steering actuator is a hydraulic actuator, said first portion of said steering actuator comprising a hydraulic cylinder and said second portion of said steering actuator being a movable piston within said first portion of said steering actuator in response to changes in hydraulic pressure within said hydraulic cylinder.

9. A marine propulsion system, comprising:

a support structure comprising a transom bracket and a steering actuator;

a drive portion of said marine propulsion system attached to said support structure, said drive portion being rotatable relative to said support structure about a steering axis, said steering actuator having a first portion and a second portion, said first portion being attached to said transom bracket and remaining stationary with respect to said transom during rotation of said drive portion about said steering axis; and a steering arm disposed within said support structure attached to said drive portion, said steering arm being rotatable within said support structure and about said steering axis.

10. The system of claim 9, wherein:

said second portion of said steering actuator is attached in force transmitting relation with said steering arm.

11. The system of claim 10, wherein:

said second portion of said steering actuator is movable along a generally straight line relative to said first portion of said steering actuator.

12. The system of claim 9, further comprising:

a sliding joint attached to said second portion of said steering actuator.

13. The system of claim 12, wherein:

said sliding joint comprises a linear component and a rotational component, said linear component being attached to said second portion of said steering actuator and said rotational component is disposed within said linear component and rotatable relative to said linear component.

14. The system of claim 13, wherein:

said rotational component is shaped to receive said steering arm in sliding relation therein.

15. The system of claim 9, wherein:

said marine propulsion system is an outboard motor.

16. The system of claim 9, wherein:

said steering actuator is a hydraulic actuator, said first portion of said steering actuator comprising a hydraulic cylinder and said second portion of said steering actuator being a movable piston within said first portion of said steering actuator in response to changes in hydraulic pressure within said hydraulic cylinder.

17. A marine propulsion system, comprising:

a support structure comprising a transom bracket and a steering actuator;

a drive unit of said marine propulsion system attached to said support structure, said drive unit being rotatable relative to said support structure about a steering axis and a tilting axis, said steering actuator having a first portion and a second portion, said first portion being attached to said transom bracket and remaining stationary with respect to said transom bracket during rotation of said drive unit about either said steering axis or said tilting axis; and a steering arm disposed within said support structure and attached to said drive unit, said steering arm being rotatable within said support structure and about said steering axis, said second portion of said steering actuator being attached in force transmitting relation with said steering arm, said second portion of said steering actuator being movable along a generally straight line relative to said first portion of said steering actuator.

18. The system of claim 17, further comprising:

a sliding joint attached to said second portion of said steering actuator, said sliding joint comprising a linear component and a rotational component, said linear component being attached to said second portion of said steering actuator and said rotational component is disposed within said linear component and rotatable relative to said linear component.

19. The system of claim 18, wherein:

said steering axis is generally vertical and said tilting axis is generally horizontal.

20. The system of claim 19, wherein:

said rotational component is shaped to receive said steering arm in sliding relation therein and said steering actuator is a hydraulic actuator, said first portion of said steering actuator comprising a hydraulic cylinder and said second portion of said steering actuator being a movable piston within said first portion of said steering actuator in response to changes in hydraulic pressure within said hydraulic cylinder.

* * * * *